United States Patent [19]

Patton et al.

[11] 4,453,594

[45] Jun. 12, 1984

[54] SOLUTION MINING OF COAL BY ELECTROLYSIS

[75] Inventors: Keith M. Patton, Peoria Heights, Ill.; Frank E. Senftle, Chevy Chase, Md.

[73] Assignee: The United States of America as represented by the Secretary of the Interior, Washington, D.C.

[21] Appl. No.: 488,481

[22] Filed: Apr. 25, 1983

[51] Int. Cl.[3] ..... C25B 1/02; C25B 3/00; C25B 9/00

[52] U.S. Cl. ..... 166/248; 204/129; 204/130; 204/131

[58] Field of Search ..... 204/130, 129, 131; 160/248

[56] References Cited

U.S. PATENT DOCUMENTS

| | | | |
|---|---|---|---|
| 2,761,829 | 9/1956 | Dolloff | 204/106 |
| 3,642,066 | 2/1972 | Gill | 166/248 |
| 3,782,465 | 1/1974 | Bell et al. | 166/248 |
| 3,819,231 | 6/1974 | Fehlner | 204/106 |
| 4,071,278 | 1/1978 | Carpenter et al. | 166/248 |

FOREIGN PATENT DOCUMENTS

| | | | |
|---|---|---|---|
| 756582 | 9/1956 | United Kingdom | 166/248 |

OTHER PUBLICATIONS

"Induction Heating Feasible for in situ Processing", Oil & Gas J., 8-1-77, pp. 94-97.

*Primary Examiner*—R. L. Andrews
*Attorney, Agent, or Firm*—Thomas Zack

[57] ABSTRACT

A electrolytic method and its associated apparatus for in situ recovery of coal products. With this method, the recoverable coal is in physical contact with a series of two or more positive electrodes while it is isolated from a single negative electrode by an electrolytic solution. The negative electrode and positive electrode are in boreholes which are drilled and are configured in the earth such that the positive electrodes may surround the single negative electrode. An electrolyte is placed in the center borehole with the negative electrode inserted in the liquid but insulated and positioned so as not to touch the coal in the side of the borehole. All of the positive electrodes in the adjacent boreholes are serially electrically connected to each other and to the positive terminal of an electrical potential difference source. The negative electrode is connected to the negative terminal of the same power source to initiate an electrolytic reaction in the coal-bearing earth. Coal products formed by this reaction may be periodically or continuously recovered and the extracted electrolyte replaced by a fresh electrolyte.

10 Claims, 3 Drawing Figures

SOLUTION MINING OF COAL BY ELECTROLYSIS

BACKGROUND OF THE INVENTION

Various methods to extract coal from the earth are well known. Depending on many factors such as the location and configuration of the coal seam and its concentration, it may not be economically practical to mine the coal by conventional methods employing cutting heads, explosives, water jets, etc. Generally, when the coal seams are too narrow to mine economically, or are located in areas where conventional coal mining methods are impractical to use, the coal is left unmined. There is a large amount of coal in the United States which falls in this category and which could add substantially to our reserves if it could be extracted. We describe herein an alternative method of recovery whereby the coal is solubilized in situ by electrolysis and the pregnant solution pumped to the surface where it is then further processed into fuel or used for petrochemical processes.

In December 1981, a paper co-authored by us and entitled "Electrolytic Oxidation of Anthracite" was published in Volume 60 of the IPC Business Press journal "Fuel." As set forth therein, the electrolytic oxidation of bituminous and/or anthracite coal is known as a laboratory method. With these previous methods, two metallic electrodes were used with the coal slurry being circulated around the positive electrode. Normally, the electrodes were separated by a permeable membrane to keep the coal particles from contacting the negative electrode. In contrast to these prior art methods, our invention described herein employs a method without a separating membrane between the electrodes as the coal itself acts as the positive electrode. As a consequence, there is a very marked increase in the oxidation efficiency with our process over the prior art methods.

In the process of oxidation, the coal is converted to various complex carboxylic acids, the exact composition of which is not known. These carboxylic acids are soluble in basic solutions. During the electrolytic process, hydrogen gas is given off at the metallic electrode surface (negative electrode) and oxygen is evolved at the nearby coal surface which acts as a positive electrode. The carboxylic acids are valuable as starting materials for the synthesis of organic compounds and plastics, and the evolved gases can be used for their usual commercial applications. Thus, all the end products are useful and recoverable.

In contrast to performing the electrolysis in the laboratory as described in the above referred report, this invention involves doing the electrolysis in situ, i.e., in the coal seam itself, to recover the mentioned valuable products. Recovery of coal components by solution mining subsequent to electrolysis precludes the necessity of strip mining or conventional mining which can be both undesirable and, in many cases, uneconomical.

SUMMARY OF THE INVENTION

A method and its associated apparatus for recovering in situ coal from the earth utilizing electrolysis. A first borehole is drilled from the surface to the recoverable coal seam. Next, an electrolyte is introduced into the borehole. Following this, a metal (negative) electrode is mounted in the center of the borehole. This electrode is coaxial with an electrically insulated sheath and fixed in the tube so that the outside metal surface is separated from the inside of the sheath. Additional boreholes transecting the coal seam may be provided around the negative or central borehole. An expanding electrode is inserted into each of these surrounding boreholes until it is adjacent the coal seam. Once these electrodes are in place, their respective expansion devices are actuated to firmly cause them to physically engage the coal seam. On the surface, electrical contact is made with all of the electrodes in the additional boreholes, and all are connected to a common point. This point will be connected to the positive terminal of a direct current power supply, and, therefore, the whole coal seam surrounding and intersecting the central hole will be a giant positive electrode. A potential difference between the negative electrode and the common positive electrodes causes an electrolysis reaction to take place in the central hole. After electrolysis has proceeded to a point where it is carrying a significant amount of acid products, it is pumped to the surface and replaced by fresh electrolyte. The extracted coal (carboxylic acid) can then be processed as desired. Also, throughout the electrolysis, hydrogen gas, formed at the negative electrode and guided to the surface by its sheath, is pumped off and stored. Likewise, oxygen formed at the coal surface flows up to the head of the central borehole and is pumped off and stored.

DESCRIPTION OF THE PREFERRED EMBODIMENT

Figure 1:
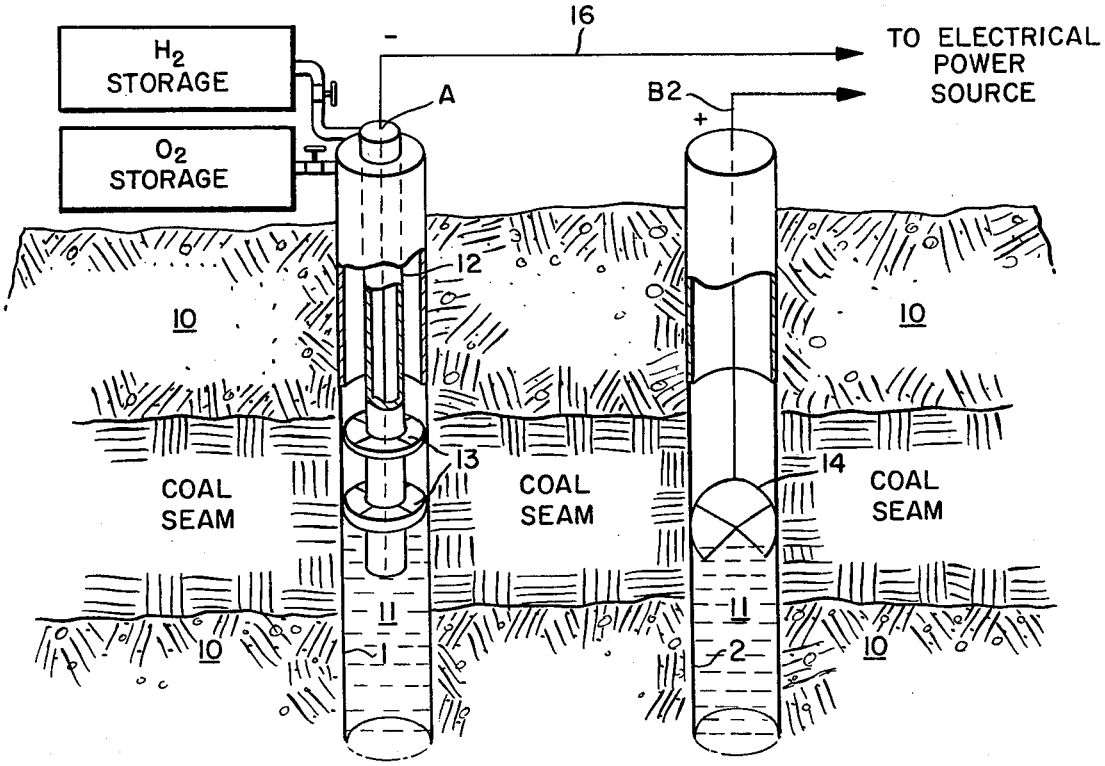
FIG. 1 is a schematic cross-sectional side view taken along long line 1-1 of FIG. 2 which illustrates two of the different polarity electrodes used.

The two electrodes of FIG. 1 are shown within their respective boreholes transecting a coal seam. Initially, the central borehole 1 incorporating the negative electrode A is drilled from the surface into the earth 10 until it transects the coal seam. An electrolyte solution 11 is then provided in the central borehole 1 to an arbitrary depth above the seam. If water is present naturally in the earth, then this electrolyte can be provided by simply adding a solid alkali such as sodium hydroxide (NaOH). Other alkali salts such as sodium chloride (NaCl) could be used. A prepared electrolyte solution could be added if there is no water present in the borehole. The particular conducting material selected for the electrolyte solution could be many materials and would depend on such factors as its cost, availability, conductivity, reaction time, etc.

Figure 2:
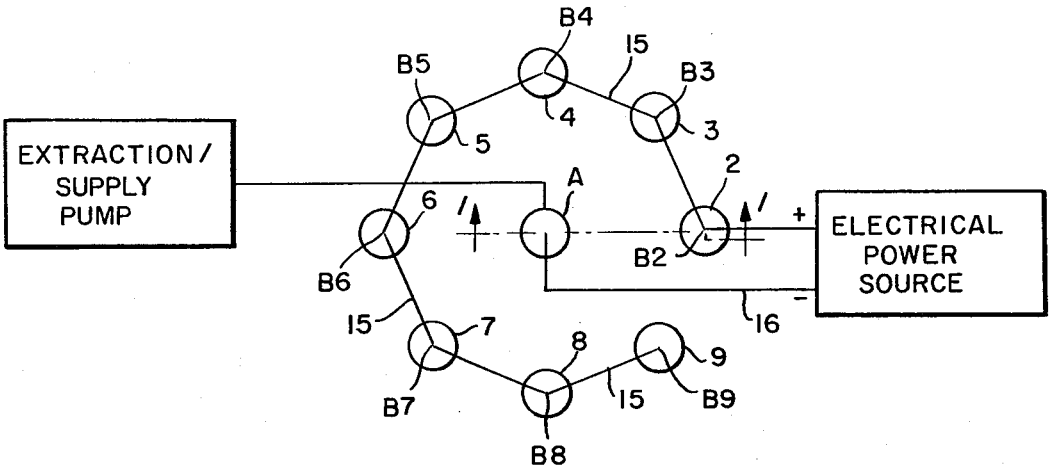
FIG. 2 is a schematic top view depicting the FIG. 1 electrodes and how a plurality of positive electrodes could be disposed in situ around the single negative central electrode.

The next step is to lower the metal elctrode A with its attached insulating tubular-shaped sheath 12 into the central hole 1. The metal wire or rod acts as the negative electrode and is provided with a sheath acts to collect and direct the flow of gas. At least one spacer 13 is needed to centralize the electrode within the borehole. This spacer can be one or more horizontally disposed circular rings (two shown) with center aligned holes to centrally position the electrode's sheath. As shown in FIG. 2, a series of additional borehole 2-9 are drilled which also transect the coal seam. These holes are disposed around the first electrode's hole 1 and constitute the receptacles for the positive electrodes. FIG. 1 illustrates one of these holes (2) as viewed along line 1-1 of FIG. 2. Thereafter, an electrode with an attached expanding member 14, is inserted into each hole. The expanding member can take various forms. Copper or brass (for conductivity purposes) arms with spikes to grip the coal can be spring activated or moved by a worm gear system driven by a small electric servo-motor controlled from the surface. Once energized, the motor drives the arms into the coal to make good electrical contact. The operation is the same for all of the holes B2 to B9. The exact placement configuration in the earth of the positive electrode(s) with respect to the negative central electrode can take many forms. In its simplest format, it could be just one positive and one negative electrode spaced from each other, i.e., as in FIG. 1. The reason we have chosen the single central negative electrode surrounded by positive electrodes configurations was to insure better contact with the coal and, as a result, insure the highest amount of current flow through the coal.

On the earth's surface, an electrical wire conductor 15 is serially connected to each of the outer eight electrodes (B2-B9 of FIG. 2) to thereby form a single common positive electrode. Next, the positive terminal of a direct current electrical power source, such as a generator, is connected to this common conductor and its negative terminal (via wire 16) to the electrode A in the central hole. The requisite voltage and current of this power source depends on many factors such as the type of coal involved, its water content, distance between the electrodes, etc. For anthracite, which is very conducive, a relatively low voltage can produce a reasonable current (0.1 amps) through the coal. Bituminous and lower grade (i.e., less percentage of carbon) coals are less conducive and many require higher voltages to cause electrolysis. We envision voltage differences from one volt to 1,000 volts as the most common range. With the appropriate potential difference applied, the electrolysis reaction in the central hole 1 proceeds and the coal can be oxidized to alkali soluble carboxylic acid and subsequently dissolved in the electrolyte. Depending on the amount of carboxylic acid produced in the electrolyte in a given time frame, the electrolyte may be periodically or continuously pumped from the borehole 1 to the surface and a fresh electrolyte introduced. The extracted electrolyte can be processed directly for petrochemicals or its dried extract used for fuel if such is economically feasible.

In addition to the extracted electrolyte, two gases are also given off and captured at or near the negative electrode during the electrolysis reaction. The end result at the negative electrode may be described by the following reaction:

$$2H^+ + 2e \rightarrow H_2.$$

At the positive electrode, some oxygen may be formed by the following reactions:

$$OH^- \rightarrow OH. + e,$$

$$OH. + OH. \rightarrow H_2O_2 + H^+ + HO._2,$$

and $$OH. + HO._2 \rightarrow H_2O_2 + O_2.$$

Figure 3:
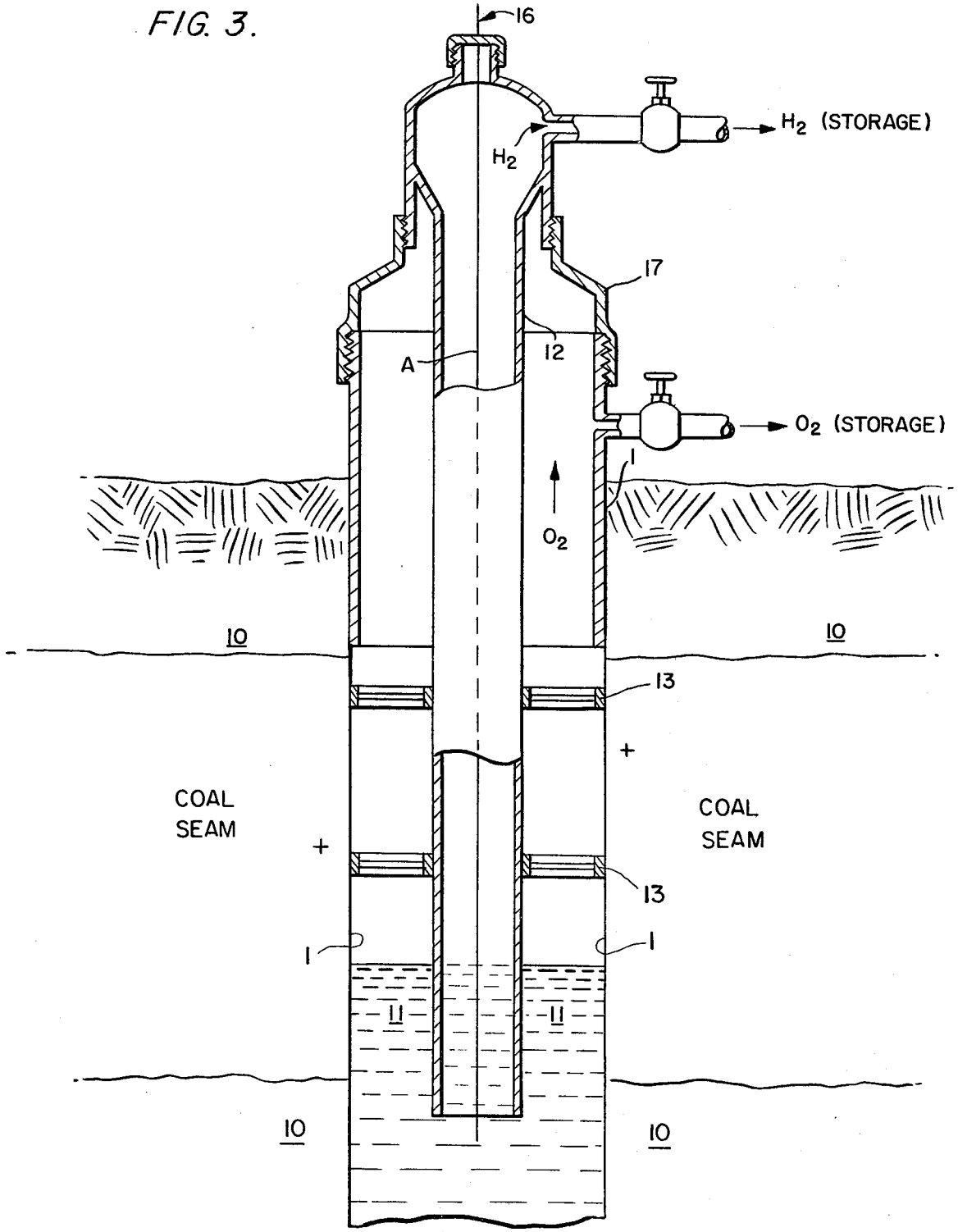
FIG. 3 is an enlarged partial view of the top surface of the FIG. 1-2 negative electrode where it engages the earth's surface.

The enlarged cut-away view of the negative electrode's upper portion near the earth's surface is shown in FIG. 3. As indicated, there is a gas tight screw threaded down gland borehole cap 17 which extends across the top of the tube from the borehole to prevent the escape of released gases to the ambient air.

The sheath 12 surrounds the negative electrode bonded to the underside of the cap by a gas tight connection. In this manner, the sheath provides a closed volume and a conduit for hydrogen ($H_2$) gas liberated at the negative electrode during the electrolysis reaction and prevents its from mixing with other gases. As best shown in FIG. 3, the bottom of the sheath 12 is open to allow the electrical conducting solution 11 to enter the sheath and thereby form the lower boundary for the closed volume. The positive terminal is formed by the coal. At the interface surface formed by the electrolyte and coal, in the same borehole in which the negative electrode is mounted, oxygen $O_2$ gas is liberated. Both of the gases are pumped and, therefore, conveyed outside of the cap by conduits extending therethrough. Thus, the volume formed by the borehole/cap and outer surface of the sheath confines the $O_2$ gas whereas the volume formed by the inner surface of the sheath-/cap confines the $H_2$ gas. These gases may be stored in temporary storage tanks for eventual transportation to industrial processors.

Tests indicate that our process requires good electrical contact between the coal and the electrodes in the peripheral holes. Some kind of a pressure contact is required which can generally be accomplished in a number of ways. For instance, a spring loaded device or a small servo-motor actuated from the surface via an electrical cable connection is adequate.

Using our method, it is proposed that coal, particularily anthracite, can be solution mined to recover (1) an oxidized humicacid like or carboxylic acid product which can be used as a fuel or as a starter material for plastics or other organic chemicals, (2) hydrogen which is a universal fuel for many purposes, and (3) oxygen, a gas which again has many commercial uses. The above invention has many advantages over conventional coal mining. (a) It precludes the necessity of stripping off overburden or making expensive mine adits to recover the coal. Therefore, there are no spoils which are undesirable, lead to acid mine water drainage, and the need to be reemplaced and replanted by law—an expensive operation. (b) The manpower involved is substantially less than in a conventional mining operation and is, therefore, less expensive. (c) The products (liquid and gas) are easier to handle than solid coal and lead to a less costly operation. (d) Solution mining can be carried out in semipopulated areas where buildings and people need not be displaced to recover the coal. (e) Recovery of coal from thin seams which is not economically feasible by conventional methods may be accomplished by solution mining.

In our preferred embodiment, an aqueous electrolyte is placed in the negative electrode's borehole and the electrolysis reaction causes oxidation to take place. This occurs because of the $OH^-$ ions from the disassociation of water used as indicated in the referred to "FUEL" publicaion. For some mining applications, it may be necessary to have a strong alkali to provide that the oxidation products will go into solution. In such situations, a 0.5 to 1.0 N (normal) sodium hydroxide solution is recommended for the electrolyte.

Variations as to the electrolyte materials, voltage levels, number and the ground spatial configuration for the boreholes and electrodes, and types and numbers of spacers and expanders are all very possible. None of these many possible changes should be used to alter the scope and spirit of our invention which is to be limited only by the claims that follows.

We claim:

1. A method for the in situ extraction of coal by electrolysis comprising the following steps:

(a) forming a first borehole from the earth's surface into the earth with said borehole transecting the seam of recoverable coal material;

(b) introducing an electrolyte into the first borehole formed in step (a), with said electrolyte contacting the recoverable coal seam;

(c) placing a metallic negative electrode in said first borehole's electrolyte, said negative electrode being spaced from and electrically insulated from the borehole's coal seam and having a sheath surrounding it to direct the flow of emitted gas;

(d) forming at least one additional borehole in the earth spaced from said borehole and extending to said recoverable coal seam;

(e) placing a metallic positive electrode in each of said at least one additional borehole, each of said positive electrodes having means thereon to insure its electrical contact with the recoverable coal seam;

(f) electrically connecting all of said positive electrodes of step (e) serially to an electrical potential difference source at its positive terminal, and also connecting the negative electrode of step (c) to the negative terminal of the same source to thereby cause a positive charge to be placed at the coal seam forming the first borehole; and (g) recovering the electrolyte and any discharged gases from said first borehole after the applied potential difference has caused an electrolysis reaction to take place therein.

2. The method of claim 1 also including the additional steps of:

(h) pumping and separating any released gases caused by the reaction to the earth's surface; and (i) replacing the electrolyte material of step (b) to insure the continuous electrolysis of the effected coal seam materials.

3. The method of claim 1 wherein there are a plurality of boreholes and electrodes formed by steps (d) and (e) with said boreholes surrounding the first borehole, each of said step (e) electrodes being serially connected.

4. The method of claim 1 including the additional step (j) of continuously replacing the electrolyte material at a rate sufficient to insure the recovery of coal products at or near its maximum rate.

5. An electrolysis recovery system used to recover in situ coal products comprising:

a first borehole with electrolyte material in the earth extending thereinto and intersecting the recoverable coal seam;

a first negative electrode having an electrically insulated gas directing sheath thereabout to direct the flow of gas, said electrode being mounted in said first borehole and spaced in an insulated manner from the recoverable coal;

at least one additional borehole in the earth spaced from said first borehole and negative electrode and extending into the coal seam;

one positive electrode in each of said at least one additional borehole, each of said positive electrodes having means to insure its electrical contact with coal seam; and means for supplying a potential difference between the negative electrode, and the positive electrodes in each of said at least one additional borehole to cause an electrolytic reaction to take place in the first borehole.

6. The system of claim 5 also including means for recovering the coal products and released gases due to the electrolysis reaction at the first borehole.

7. The system of claim 6 wherein there are a plurality of boreholes and positive electrodes constituting the at least one additional borehole and electrodes, said plurality of electrodes being serially connected to each other and to the positive terminal of the means for supplying a potential difference.

8. The system of claim 7 wherein said plurality of boreholes are spaced in the earth around said first borehole, and the insulation for the negative electrode in the first borehole has an elongated sheath with a spacer.

9. The system of claim 8 wherein the means to insure the electrical contact with the coal seam is an expandable member attached to the positive electrode which can be actuated from the surface to expand in the borehole.

10. The system of claim 9 wherein the means for recovering the coal products and released gases includes a gas tight seal over the first borehole connected to pumps to force release gases into storage containers.

* * * * *